US008547237B2

(12) United States Patent
Adebimpe

(10) Patent No.: US 8,547,237 B2
(45) Date of Patent: Oct. 1, 2013

(54) CREATURE-MACHINE HYBRID DETECTOR SYSTEM FOR THE AUTONOMOUS AND MULTIMODAL DETECTION OF ILLICIT AND HAZARDOUS MATERIALS

(75) Inventor: David O. B. A. Adebimpe, Annapolis, MD (US)

(73) Assignee: David O. B. A. Adebimpe, Annapolis, MD (US)

( * ) Notice: Subject to any disclaimer, the term of this patent is extended or adjusted under 35 U.S.C. 154(b) by 517 days.

(21) Appl. No.: 12/457,212

(22) Filed: Jun. 3, 2009

(65) Prior Publication Data

US 2010/0045459 A1 Feb. 25, 2010

Related U.S. Application Data

(60) Provisional application No. 61/130,954, filed on Jun. 3, 2008.

(51) Int. Cl.
*G08B 23/00* (2006.01)

(52) U.S. Cl.
USPC ..... 340/573.2; 73/23.34; 119/712; 119/720; 340/573.1; 340/573.3

(58) Field of Classification Search
USPC ..... 340/573.1, 573.2, 573.3; 119/712, 119/720; 73/23.34; 702/188
See application file for complete search history.

(56) References Cited

U.S. PATENT DOCUMENTS

| | | | | |
|---|---|---|---|---|
| 6,721,681 | B1 * | 4/2004 | Christian et al. | 702/178 |
| 2007/0222624 | A1 * | 9/2007 | Eicken et al. | 340/573.3 |
| 2008/0163671 | A1 * | 7/2008 | Dugan | 73/23.34 |
| 2009/0044761 | A1 * | 2/2009 | Chapin et al. | 119/720 |

* cited by examiner

*Primary Examiner* — Brent Swarthout

(57) ABSTRACT

The present invention relates to a creature-machine hybrid detector system capable of autonomously detecting illicit and hazardous materials. This hybrid detector comprises of an explosives detecting creature trained in the art of detecting illicit and hazardous materials that is additionally outfitted with a battery operated lightweight and portable electronics-based detector machine ensemble capable of real-time characterizations of vapor, liquid and gaseous phase materials towards which the creature displays a positive alert response, two-way wireless video, data, voice, location and image connectivity, a creature-heartbeat detector, and the capacity for interaction to remote personnel within the field of operations through a hand-held display or to a central control unit. Such a detector will combine the autonomous search-and-detect capability of a detector creature trained in the art of detection of illicit and hazardous materials with the multi-perspective material identification and characterization capability of electronics-based detector machines and instruments and will have superb advantages over currently available biological or electronic detection systems.

7 Claims, No Drawings

CREATURE-MACHINE HYBRID DETECTOR SYSTEM FOR THE AUTONOMOUS AND MULTIMODAL DETECTION OF ILLICIT AND HAZARDOUS MATERIALS

CROSS-REFERENCE TO RELATED APPLICATIONS

This application claims the priority benefit to U.S. Provisional Patent Application No. 61/130,954 titled A Creature-Machine Hybrid Detector System for the Autonomous and Multimodal Detection of Illicit and Hazardous Materials, to David O. B. A. Adebimpe, filed Jun. 3, 2008, and which is incorporated by reference herein in its entirety.

STATEMENT REGARDING FEDERALLY SPONSORED RESEARCH

Not Applicable

FIELD OF INVENTION

The present invention generally relates to techniques that can be used in the detection of illicit and hazardous materials such as explosives and narcotics. More specifically, the present invention discloses hybrid Creature-Machine detectors that combine the search-and-detect capability of an explosives, narcotic, human, agricultural produce or money detecting creature, the real-time material identification and characterization capability of a detector machine and a means of communicating this information, and others such as visual images of machine/creature location and creature health condition, to a central control unit or hand held device.

BACKGROUND OF THE INVENTION

Governments of nations from all around the world are currently establishing a host of security programs to ensure the protection of their national treasures, infrastructure, citizenry, and to establish social order. One example of such programs is in the detection of illicit and hazardous materials such as drugs, explosives, chemical and biological contaminants.

For the detection of these abovementioned materials, two approaches are normally used. The first approach involves the use of electronics-based detection machines and instruments. These machines and instruments typically operate using methods based on a wide array of spectroscopic, electrical or magnetic principles. From these principles have emerged traditional detection machines based on technologies such as the x-ray, gas chromatographic and nuclear quadruple resonance machines, to emergent detection machines based on chemical and electronic nose nanotechnology based sensors, and non-ionizing terahertz, infrared and fluorescence spectroscopy, interferometry and imaging techniques.

The major advantages of detection machines and instruments include their parts-per-billion sensitivity to vapor detection and the fact that different technologies and principles of operation can be used simultaneously within a singular detection configuration.

However, a disadvantages imposed by the use of machines or instrument detection is that the machine itself is not capable of an autonomous search-and-detect process of detection within a defined space or area. It cannot "see."

The second approach to detection is of a biological nature and takes advantage of the olfactory capacity of creatures such as canines, bees, rats and fishes such as sharks and the catfish to detect illicit and hazardous materials, specifically employing their capacity to detect sub-parts-per-million amounts of a scent or odor exuded by a material and then trace the odor back to its source, and the fact that they are easy to train by humans in search-and-detect operations.

However, a major limitation of detector creatures is the fact that they cannot communicate to humans the exact nature of the illicit or hazardous material what they are positively alerting to nor can they confirm the nature of the scent trail they are following. Also, their senses of detection are wholly based on principles pertaining to olfaction.

It would be beneficial to have a bio-machine hybrid detector that combines the autonomous search-and-detect capability of a detector creature that is trained in the art of detection of illicit and hazardous materials with the multi-perspective material identification and characterization capability of electronics-based detector machines and instruments, as such a detector will have superb advantages over currently available biological or electronic detection systems in the detection of materials such as explosives, narcotics, laundered currency, fugitives and agricultural produce.

SUMMARY OF THE INVENTION

The present invention is a hybridized creature-machine detection unit capable of the autonomous and multimodal detection of illicit or hazardous materials, wherein the detector unit comprises of (a) a detector creature that is previously trained in the detection of illicit, illegal and hazardous materials, and outfitted with (b) a machine, instrument or electronic device comprising of a detection system capable of analyzing and identifying illicit and hazardous materials, and whereby the detector creature, whilst partaking in the process of detection, as the source of mobility and direction for the hybrid detector while the machine component simultaneously detects, analyzes and identifies the physicochemical characteristics of the material being tracked and detected by the creature, in real time.

It is an embodiment of the present invention, wherein the detector creature is chosen from the group of mammals, birds, insects and fish.

It is an embodiment of the present invention, wherein the detecting machine, instrument or electronic device is capable of bulk or trace detection methods.

It is an embodiment of the present invention, wherein the detecting instrument or machine uses the technologies of neutron or nuclear analysis, spectrophotometry, chromatography, optics, electromagnetism, electronics, resonance, biosensing or imaging for detection.

It is an embodiment of the present invention, wherein the illicit or hazardous material to be detected is of a chemical or biological nature.

It is an embodiment of the present invention, wherein the detector creature is an explosives detecting creature It is an embodiment of the present invention, wherein the detector creature is a narcotics detecting creature It is an embodiment of the present invention, wherein the detector creature is human-scent tracking creature It is an embodiment of the present invention, wherein the detector creature detects chemical and biological contaminants It is an embodiment of the present invention, wherein the detecting creature is a canine, mouse or fish It is an embodiment of the present invention, wherein the illicit or hazardous material is an explosive substance.

It is an embodiment of the present invention, wherein the illicit or hazardous material is a narcotic substance.

It is an embodiment of the present invention, wherein the illicit or hazardous material is an agricultural produce.

It is an embodiment of the present invention, wherein the illicit or hazardous material is an animal or a human being It is an embodiment of the present invention, wherein the instrument is attached to a harness that can be attached to the body of the creature.

It is an embodiment of the present invention, wherein information from the machine, instrument or electronics device can be wirelessly transmitted.

It is an embodiment of the present invention, wherein the instrument or machine is strapped to the body of the creature It is an embodiment of the present invention, wherein the harness is a vest or neck collar for the creature It is an embodiment of the present invention, wherein the harness is a chest harness or back harness for the creature It is an embodiment of the present invention, wherein the harness is a head harness for the creature It is an embodiment of the present invention, wherein the machine or instrument-based component of the hybrid detection system also comprises a microphone, ear piece, GPS locator, video camera, temperature and humidity sensor, lights, compass, and heartbeat detecting and monitoring components, a battery pack, and a wireless transmitter to transmit information from all these components to a remote receiver unit.

It is an embodiment of the present invention, wherein all instruments can be battery operated It is an embodiment of the present invention, wherein the batteries are rechargeable by electric charging It is an embodiment of the present invention, wherein the batteries can be recharged using solar energy It is an embodiment of the present invention, wherein the instrument data can be wirelessly transmitted It is an embodiment of the present invention, wherein components data can be wirelessly transmitted It is an embodiment of the present invention, wherein the machine components are rendered water resistant.

It is an embodiment of the present invention, wherein the explosive substance is selected from the group consisting of 5-nitro triazol-3-one (NTO), trinitrotoluene (TNT), trinitrotriamino benzene (TATB), 3,5-dinitro-2,6-bis-picrylamino pyridine (PYX), nitroglycerine (NG), ethylene glycol dinitrate (EGDN), diethylene glycol dinitrate (DEGDN), 2,2-bis [(nitroxy)methyl]-1,3-propanediol dinitrate (or pentaeritol tetranitrate) (PETN), trimethylol ethyl trinitrate (TMETN), tetryl, hexahydro-1,3,5-trinitro-1,3,5-triazine (RDX), methylamine nitrate, octahydro-1,3,5,7-tetranitro-1,3,5,7-tetrazocine (HMX), nitroguanidine, potassium nitrate, ammonium nitrate, urea nitrate, ammonium picrate, nitrocellulose, triacetone triperoxide (TATP), diacetone peroxide, tributanone triperoxide (TBTP), hexamethylene triperoxide (HMTD), mannitol hexanitrate, cyclohexanone peroxide, smokeless powder, black powder, diacetone alcohol peroxide, methylcyclohexanoneperoxide, or any combinations thereof.

It is an embodiment of the present invention, wherein the narcotic substance is selected from the group consisting of cocaine, heroin, amphetamines, methylenedioxymethamphetamines, marijuana, barbiturates, or any combinations thereof.

It is an embodiment of this invention, that other materials to be detected include money, guns and the human scent of fear and excitement.

The subject matter disclosed in the "Summary" is not an exhaustive or complete disclosure of the entire scope of the technology or any embodiments thereof.

DETAILED DESCRIPTION OF THE INVENTION

The following description is merely exemplary in nature of the subject matter, and is not intended to limit the scope, application, or uses of any specific invention claimed in this application or in such other applications as may be filed claiming priority to this application, or patents issuing therefrom. Also, the headings and sub-headings used herein are intended only for general organization of topics within the present disclosure, and are not intended to limit the disclosure of the technology or any aspect thereof.

Introduction

Governments of nations from all around the world are currently establishing a host of security programs to ensure the protection of their national treasures, infrastructure, citizenry, and to establish social order. In the forefront of such programs are increased efforts in the detection of illicit materials such as drugs, illegal materials such as explosives, hazardous materials such as chemical and biological contaminants, and activities such as drug and human trafficking, money laundering, illegal produce smuggling and for the detection of escaped or wanted persons.

Types and Limitations of Current Detector Systems

For the detection of any of the above-mentioned, two approaches are normally used. Each approach has its own advantages and disadvantages that make the need for better detection systems desirable.

The first approach is the use of scientific technology. It involves the use of bulk and trace detection instruments and machines based on principles utilizing a wide range of technologies ranging from established technologies such as the x-ray, gas chromatographic and nuclear quadruple resonance machines, to emerging technologies such as biosensor electronic nose sensing nanotechnologies and remote terahertz, infrared and fluorescence spectrometric and imaging techniques.

The major advantages of machine instrumentation include their parts-per-billion sensitivity to vapor detection and the fact that different technologies and principles of operation can be used simultaneously within a singular detection (fused detection) configuration.

However, the disadvantages imposed by the use of machines or instrument detection are numerous. One major disadvantage of these detection methods is that machine sensitivity and throughput expectations of such technology(ies) within ports-of-entry and areas of mass transit are so high that it translates to the machine's footprint being designed as to be big or bulky, and totally immobile.

Another disadvantage is that these machines are totally dependent on electricity and require plugging into an electricity outlet in order to function.

Yet another disadvantage is that the machine itself is not capable of an autonomous search-and-detect process of detection within a defined space or area nor is it capable to tracking a scent or odor to source without help.

Furthermore, albeit sensitive, the effectiveness of these machines are solely dependent on the anticipation that the carrier of an illegal and illicit material decides, on their own volition, to pass through the machine for inspection and take a chance that the illicit or illegal material is well concealed enough to pass through the machine undetected.

The second approach involves the use of biology. Specifically, it involves the using advantageously, the highly developed olfactory capacity of creatures who practically have to "smell to see," in the detection of illicit, hazardous and illegal materials. Such creatures include land creatures such as canines, bees, rats to sea creatures such as dolphins, sharks and the catfish.

This approach applies their capacity to detect sub-parts-per-million amounts of a scent or odor exuded by a material, and to trace such odor back to its source. Detector creatures such as sharks, bees and canines are known to have scent detection capacity that matches the sensitivities of the best vapor detecting machines available today. Also, they are easy to train by humans in search-and-detect operations. Canines, as a specific example, have been used, successfully, over many years, to detect explosives, drugs, money, humans, and even human ailments such as cancer, using the odor profiles and scent signatures of these materials. They can detect sub-ppm amounts of the trace odor or scent signature of an illegal or illicit material that they have been trained to detect, "key" onto the odor, and trace it source material.

However, a major limitation of detector creatures is the fact that they cannot communicate to humans the exact nature of the illicit or hazardous material what they are positively alerting to nor can they confirm the nature of the scent trail they are following. In most cases, the human handler does not know either.

So, although canines are proficient in material detection, when they do pick up a trail, they are unable to inform the handler the exact nature of the scent they are following nor what the illicit material the scent or scent signature represents. They are also not capable to eliminating any threat the material detected might present.

The limitations imposed by the independent use of machine or creature detection methods are such that although detecting creatures do detect illicit and hazardous materials with high specificity, they are unable to inform their respective handlers of the specific nature of the illicit or hazardous material they are actually detecting or displaying an alert towards. Instruments and machines based on technology on the other hand are capable of a multi-perspective analysis of vapors, liquids and material; however, they are only capable of point-detection.

Creature-Machine Hybrid Detection

A method of detection is hereby disclosed, which utilizes the advantageous aspects of both approaches and hybridizes the best of biological and electronic detection in the development of bio-machine hybrid units that can autonomously detect illicit and hazardous materials.

Such a bio-machine hybrid detector will combine the autonomous search-and-detect capabilities of a detector creature trained in the art of detection of illicit and hazardous materials with the multi-perspective material identification and characterization capability of electronics-based detector machines and instruments and will have superb advantages over currently available biological or electronic detection systems.

Within this method a creature trained in the art of scent-and-detecting illicit and hazardous materials is outfitted with a battery-operated, lightweight and portable machine comprising of electronics or technology-based detector machine or instrumentation that is capable of real-time characterizations of vapor-, liquid- and gaseous-phase materials within the tracking path of the detector creature, including materials to which the creature has been previously trained to display a positive alert response towards, and the capability of wirelessly sending information of material characteristics from the machine or instrumentation, along with video, voice, creature health, location and image information, to handheld devices held by remote personnel within the field of operations or to a central control unit.

The combination (or convergence) of both creature and machine based detection methods lead to the formation of a hybrid detection system that is greater than the sum of its parts. With its search-and-detect capacity of a detector creature, the creature (K9) component of the hybrid will be able to autonomously detect the trace of a scent and track it back to source; and, with its analytical and characterization capabilities, the portable analytical machine component of the hybrid is able to analyze the odor, odors and/or scent signature the creature is tracking or alerting towards, in real time, identify such odors and pair it with a material.

In situations whereby the creature alerts and sits next to the material, video technology may be used to give precision to the placement of a remote controlled instrument probe already preexisting as an integral part of the machine, while other characterization components such as spectroscopic, chromatographic or imaging methods will allow the machine to do a final analysis of the material.

Technology such as voice or sound technology may be used to elicit the canine to perform further activities such as body positioning to align the machine at certain orientations with respect to the detected material and barking or whining to activate disarming components that may be part of the machine ensemble.

The machine may contain further components, devices or instruments that may further help in disarming or neutralizing the detected material. Such components may disarm the material by pulling out a material-activating wire or by pouring an event-neutralizing liquid on the material.

The portable analytical machine component may contain one, or a combination, of the currently used principles of detection or emergent technologies available for the detection of trace and bulk amounts of hazardous and illicit materials. Such technologies include, and are not limited to biological, chemical, optical, nuclear, electromagnetic, imaging, interferometric, spectrophotometric and chromatographic based analytical technologies such as gas chromatography, nuclear magnetic and quadrupole resonance, mass spectrometry, chemiluminescence, thermo-redox, terahertz, fluorescence and x-ray spectroscopy, antigen/antibody and other forms of biosensors, and electronic and optical nose nanotechnologies.

An example of technology suitable for this activity is the fluorescence amplification technology exemplified in the Fido® explosives detector manufactured by ICx Technologies, Inc. Another example is the gas spectroscopy and ion mobility technology exemplified in the "Mobile Trace®" vapor and particulate detector manufactured by General Electric (GE Security Systems). Another technology suitable for this activity is the surface acoustic wave technology exemplified in the z-Nose illicit and hazardous materials detector manufactured by Electronic Sensor Technology, LP. Such instruments can be used by themselves, with each other, or in combination with other instruments to form multimodal detection systems.

For detection in aqueous environments, an aquatic creature with detector capabilities such as a shark or catfish can be trained for detection and thereafter outfitted with an instrument that operates on the principles of an aqueous-environment detection technology such as liquid chromatography, voltammetry/electrolysis, and fluorescence, with and without an additional capability for nanofilteration of the illicit or hazardous material samples for further on-land analysis.

Based on its operational analytical principles, the portable analytical component or group of components attached to the detector creature may also be able to identify the material that the creature is trailing, from the scent composition of the scent trail, without the creature physically arriving and alerting at the material.

The analytical component will be able to identify the material being tracked and transmit the identity of scent components, including quantitative factors such as concentration profile, to a human observer or handler through a hand-held display or to a control center. In most cases, the overall scent signature and the presence, amount and ratio of components within the signature changes as the creature get closer to the material.

At the same time, through additional wireless communication capabilities, the real-time analytical and transmission capabilities of the machine will provide the handler/control center information about the nature of the material being tracked and provides time to take necessary procedures applicable for that type of material, while still waiting for the creature to actually find the material.

Such a hybrid unit will allow response personnel to enact appropriate response procedures sooner than the use of prior techniques. Response procedures vary according to the material being detected and require different logistics and mindsets. For example, an appropriate procedure for the detection of explosives will be to subtly evacuate the building while an appropriate procedure for the detection of drugs will be to subtly seal the building.

It will also allow the use typically unused creature detection scopes, such as, for example, the use of a single canine for both explosives and narcotic detection processes.

Thus, in an intimate and synergic relationship, the detector creature will bring motility to the machine and simultaneously provide the machine with an autonomous sense of "sight, smell, and direction" to aid detect and identify the nature of an illicit material, with both detector types working as one as an autonomous detection device.

A non-limiting example illustrating a scenario achievable by the developed creature-machine hybrid detection system is as follows: when a detector creature trained in search-and-detect activities, such as a canine, senses the scent signature (or a component of the scent signature) of a material it has been trained to detect and then starts to track the material by moving into the scent trail, both the overall concentration material-specific scent signature and the amount and ratio of components within the signature changes as the creature gets closer to the material. As the canine moves into the scent cone and commences tracking, the portable analytical instrument (s) component of the machine harnessed to the creature will start to analyze, information about the material scent being detected by the creature, identify the nature of the material being tracked, confirm the tracking and alert decisions elicited by the canine, and, due to its ability to process information pertaining to the scent concentration and composition of the headspace scent signatures within the scent cone, predict the physical proximity of the canine to the illicit material.

When the canine arrives at the material and alerts to the material, further detailed scrutiny of the material can be done by the analytical instruments it harnesses, with the use of robotic probes if necessary. Other quantitative factors as the concentration of the material and changes in concentration as the creature enters the scent cone can also be electronically monitored by the machine or instrument.

The described bio-machine hybrid detection system is completely autonomous and its mobility and directionality is driven by the detector creature's detection capabilities and its capacity to track, advance towards and detect illicit or hazardous material. At the same time the machine's sense of direction is "powered" by the canine serving both as a sense of sight and smell.

Visual, audio, and electronic data of detector location, prevailing environmental conditions, vital functions of the creature such as heart rate, and analytical data obtained during the detection process can be wirelessly transmitted to a command center. The canine itself can be given further commands, through microphones, or a mini speaker attached to the machine, to further address the detected material. The machine component may be further activated by the control center to enable it perform other functions such as further analysis of the detected material or mitigating its illicit or hazardous property.

EXAMPLES

Now that the present invention has been generally described, the following non-limiting examples are set forth to fully detail methods of making a Creature-Machine hybrid detector unit for the autonomous and multimodal detection of illicit and hazardous Materials. However, these examples are not to be construed as a limitation on other ways of making the present invention. Embodiments clear to one of ordinary skill and thought are within the scope of the present invention.

Example 1

A Creature-Machine Hybrid Detector for the Detection of TNT

A creature-machine hybrid detector unit was prepared by outfitting a canine (dog) that has been trained in the art of detecting chemical explosives, including TNT, with a Mobile Trace vapor detecting machine manufactured by General Electric and that was set to the "explosives detection" and "vapor detection" mode. The outfitting was achieved by placing the machine within a side pouch constructed onto the topside part of a vest being worn by the canine. The meshed pouch had two open sides to allow the sampling ports of the machine to be exposed, unrestricted to the air for sampling. The machine was also connected to a 260 ft cable to allow the canine the distance it needs to find and detect the material that needs to be detected.

A TNT training aid was hidden within a 3,200 sq ft warehouse stocked with home improvement materials. The specific placement of aid was unknown to the handler or the canine. After the aid had been left for a period of ten minutes in order to allow the permeation of its odor into the surroundings, the canine-machine hybrid detector unit was brought into the warehouse by the canine handler to fully roam the warehouse and search-and-detect the training aid. At this stage, the machine component of the hybrid was plugged into the mains, switched on, calibrated, snugly fitted into the pouch, and the handler released the canine to allow it to roam the warehouse unrestricted, and with his instructions the canine started to autonomously systematically searching the warehouse, with no time constrictions imposed.

Within 20 seconds, the canine showed a strong interest in a scent trail which led it to the area where the training aid had been hidden. When it got to the box in which the training aid was been placed, the canine showed behavioral cues normally associated with finding an explosive material, which was sitting down next to the box without nudging it, to indicate the presence of a scent similar to that of an explosive scent that they had been trained to detect. After sitting by the box for 20 seconds, the mobile trace machine started beeping, which is an indication that an explosive material had been found. A look at its display indicated that the explosive material detected was TNT.

Example 2

A Creature-Machine Hybrid Detector for the Detection of Cocaine

A creature-machine hybrid detector unit was prepared by outfitting a canine that has been trained in the art of detecting narcotics, including Cocaine, with a Mobile Trace vapor detecting machine manufactured by General Electric and that was calibrated for cocaine detection and set to the "vapor detection" mode. The outfitting was achieved by placing the machine within a side pouch constructed onto the topside part of a vest being worn by the canine. The meshed pouch had two open sides to allow the sampling ports of the machine to be exposed, unrestricted to the air for sampling. The machine was also connected to a 260 ft cable to allow the canine the distance it needs to find and detect the material that needs to be detected.

Six cocaine training aids were hidden within a 300 sq ft office. The specific placement of aid was unknown to the handler or the canine. After the aid had been left for a period of 3 hours in order to allow the permeation of its odor into the surroundings, the canine-machine hybrid detector unit was brought into the warehouse by the canine handler to fully roam the office and search-and-detect the training aid. At this stage, the machine component of the hybrid was plugged into the mains, switched on, calibrated, snugly fitted into the pouch, and the handler released the canine to allow it to roam the office space unrestricted, and with his instructions the canine autonomously started to systematically searching the warehouse, with no time constrictions imposed.

Within 20 seconds, the canine showed a strong interest in a scent trail which led it to the area where the training aid had been hidden. When it got to the box in which the training aid was been placed, the canine showed behavioral cues normally associated with showing an interest in an area, which was excitedly and repeatedly searching a particular area, but the canine did not fully alert to indicate the definite presence of a scent similar to that of an explosive scent that they had been trained to detect. After searching the particular area for a period of 56 seconds, the mobile trace machine started beeping, which is an indication that a narcotic material had been found. A look at its display indicated that the narcotic material detected was cocaine.

Example 3

A Creature-Machine Hybrid Detector for the Detection of TATP

A creature-machine hybrid detector unit was prepared by outfitting a canine that has been trained in the art of detecting chemical explosives, including TATP, with a Mobile Trace vapor detecting machine manufactured by General Electric and that was set to the "explosives detection" and its "vapor detection" mode. The outfitting was achieved by placing the machine within a side pouch constructed onto the topside part of a vest being worn by the canine. The meshed pouch had two open sides to allow the sampling ports of the machine to be exposed, unrestricted to the air for sampling. The machine was also connected to a 260 ft cable to allow the canine the distance it needs to find and detect the material that needs to be detected.

A TATP training aid was hidden within a 3,200 sq ft warehouse stocked with home improvement materials. The specific placement of aid was unknown to the handler or the canine. After the aid had been left for a period of ten minutes in order to allow the permeation of its odor into the surroundings, the canine-machine hybrid detector unit was brought into the warehouse by the canine handler to fully roam the warehouse and search-and-detect the training aid. At this stage, the machine component of the hybrid was plugged into the mains, switched on, calibrated, snugly fitted into the pouch, and the handler released the canine to allow it to roam the warehouse unrestricted, and with his instructions the canine autonomously started to systematically searching the warehouse, with no time constrictions imposed.

Within 20 seconds, the canine showed a strong interest in a scent trail which led it to the area where the training aid had been hidden. When it got to the box in which the training aid was been placed, the canine showed behavioral cues normally associated with finding an explosive material, which was sitting down next to the box without nudging it, to indicate the presence of a scent similar to that of an explosive scent that they had been trained to detect. After sitting by the box for 20 seconds, the mobile trace machine started beeping, which is an indication that an explosive material had been found. A look at its display on the machine indicated that the explosive material detected was TATP.

Example 4

A Creature-Machine Hybrid Detector for the Detection of Cocaine and TNT

A creature-machine hybrid detector unit was prepared by outfitting a canine that has been trained in the art of Cocaine, with the sampler component of a zNose® 4300 portable battery operated vapor detecting machine manufactured by Electronic Sensor Technology, LP, and that was calibrated for general explosives and narcotics detection. The outfitting was achieved by placing the machine within a side pouch constructed onto the topside part of a vest being worn by the canine. The meshed pouch had two open sides to allow the sampling ports of the machine to be exposed, unrestricted to the air for sampling.

One cocaine and two TNT training aids were hidden together within a 300 sq ft office. The specific placement of aid was unknown to the handler or the canine. After the aid had been left for a period of 15 minutes hours in order to allow the permeation of its odor into the surroundings, the canine-machine hybrid detector unit was brought into the warehouse by the canine handler. The handler released the canine to allow it to roam the office space unrestricted, and with his instructions the canine autonomously started to systematically searching the warehouse, with no time constrictions imposed.

Within 10 seconds, the canine showed a strong interest in a scent trail which led it to the area where the training aid had been hidden. When it got to the box in which the training aid was been placed, the canine showed behavioral cues normally associated with the passive alert to finding a narcotic material, which was sitting down next to the box without nudging it, to indicate the presence of a scent that they had been trained to detect. After sitting by the box for 20 seconds, the mobile trace machine started beeping, which is an indication that an explosive material had been found. Although the canine was only trained to detect cocaine, a look at its display on the machine indicated that the materials detected were both cocaine and TNT.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the merits and bounds of the claims, or equivalence of such merits and bounds are to be included within the spirit and purview of this application and scope of the appended claims.

What is claimed is:

1. A hybridized creature-machine method of autonomous detection of illicit or hazardous materials, comprising: mounting a machine, instrument, or electronic device capable of analyzing and identifying illicit substances on a detection-creature previously trained in identifying illicit substances, said machine, instrument, or electronic device further comprising a microphone, ear piece, GPS locator, video camera, temperature and humidity sensor, lights, compass, and heart-beat detecting and monitoring components, a battery pack, and a wireless transmitter to transmit information from all these components to a remote receiver unit.

2. The method of claim 1 wherein all instruments can be battery operated.

3. The method of claim 2 wherein the batteries are rechargeable by electric charging.

4. The method of claim 2 wherein the batteries can be recharged using solar energy.

5. The method of claim 1 wherein the instrument data can be wirelessly transmitted.

6. The method of claim 1 wherein components data can be wirelessly transmitted.

7. The method of claim 1 wherein the machine components are rendered water resistant.

* * * * *